US011851315B2

(12) United States Patent
Walton et al.

(10) Patent No.: US 11,851,315 B2
(45) Date of Patent: Dec. 26, 2023

(54) FLOW TERMINAL FOR A CONTAINER DIP TUBE

(71) Applicant: POLYKEG S.R.L., Bergamo (IT)

(72) Inventors: Philip Andrew Walton, Bishop Auckland (GB); Sergio Sonzogni, Bergamo (IT)

(73) Assignee: POLYKEG S.R.L.

( * ) Notice: Subject to any disclaimer, the term of this patent is extended or adjusted under 35 U.S.C. 154(b) by 0 days.

(21) Appl. No.: 17/614,399

(22) PCT Filed: Jun. 8, 2020

(86) PCT No.: PCT/GB2020/051384
§ 371 (c)(1),
(2) Date: Nov. 26, 2021

(87) PCT Pub. No.: WO2020/249933
PCT Pub. Date: Dec. 17, 2020

(65) Prior Publication Data

US 2022/0234878 A1 Jul. 28, 2022

(30) Foreign Application Priority Data

Jun. 10, 2019 (GB) ..... 1908215

(51) Int. Cl.
*B67D 1/04* (2006.01)
*B67D 1/08* (2006.01)
*B67D 1/12* (2006.01)

(52) U.S. Cl.
CPC ..... *B67D 1/0802* (2013.01); *B67D 1/0462* (2013.01); *B67D 1/1202* (2013.01); *B67D 1/1272* (2013.01); *B67D 2001/0824* (2013.01); *B67D 2001/0825* (2013.01); *B67D 2001/0827* (2013.01); *B67D 2001/0828* (2013.01)

(58) Field of Classification Search
CPC ..... B67D 1/0802; B67D 1/1202; B67D 2001/0824; B67D 2001/0825; B67D 1/0462; B67D 1/1272; B67D 2001/0827; B67D 2001/0828
See application file for complete search history.

(56) References Cited

U.S. PATENT DOCUMENTS

| | | | | |
|---|---|---|---|---|
| 3,156,252 | A | 11/1964 | Johnston | |
| 9,233,827 | B2 * | 1/2016 | Wanless | B67D 7/0266 |
| 2009/0211647 | A1 * | 8/2009 | Anderson | B67D 1/0831 137/68.23 |

FOREIGN PATENT DOCUMENTS

| | | |
|---|---|---|
| DE | 3515351 | 10/1986 |
| DE | 20 2005 002779 | 7/2006 |
| GB | 1529443 | 10/1978 |

(Continued)

*Primary Examiner* — Frederick C Nicolas
(74) *Attorney, Agent, or Firm* — Galbreath Law Offices, P.C.; John A. Galbreath

(57) ABSTRACT

A flow diverting device is provided at the lower end of the dip-tube (D) in a bag-in-keg container (C) which is filled top-side-down, e.g. with beer. The device directs the incoming flow to run smoothly back down the outside of the dip tube, gently into the already pooled beer thus minimising any fountain effect and associated turbulence. The device can also be used with single-wall metal or plastic kegs to reduce the dispensing of sediment and allow a greater volume of beer to be withdrawn without fobbing.

9 Claims, 7 Drawing Sheets

(56) References Cited

FOREIGN PATENT DOCUMENTS

| | | |
|---|---|---|
| GB | 2 228 049 | 8/1990 |
| WO | WO 2005/113416 | 12/2005 |
| WO | WO 2013/074782 | 5/2013 |

* cited by examiner

FLOW TERMINAL FOR A CONTAINER DIP TUBE

TECHNICAL FIELD OF THE INVENTION

This invention relates to a flow terminal for a container dip tube, e.g. for beer kegs.

BACKGROUND

Kegs may be used to hold and transport various liquids. They are frequently used to transfer beer from a brewery to the point of dispense for example. Typically, a beer keg has a capacity of 10 to 50 litres and consists of a pressure resistant metal or plastic container with a combined two-port valve. FIG. 1 shows a typical metal keg which comprises a container body C, a top chime TC which facilitates handling of the keg, and a bottom chime BC which provides stable support for the keg. (Plastic kegs may not have a bottom chime, as described in EP 2 640 646-A.) The two-port valve V is located centrally of the top chime and is shown in greater detail in FIG. 2. When the valve is opened using a suitable coupling connector (see below) the valve provides two separate pathways in and out of the keg. The first pathway A has a keg opening adjacent to the valve and the second pathway B opens at the opposite end of the keg via a dip tube D. These pathways allow the exchange of gas and liquid, firstly to fill the keg and, later, to dispense the beer. There a several common types of valve which have differing connecting systems for these flow paths, e.g. types A, S, D, G and M.

Kegs are normally dispensed with the valve orientated upwards (top-side-up). This gives convenient access for the operator to connect and disconnect a coupling connector. Pressurised gas in introduced through the first flow path A into the top of the keg thus allowing the beer to be drawn off from the bottom of the keg via the dip tube D through the second flow path B. Kegs are normally refillable, and as the contents of the kegs are normally intended for human consumption the kegs need to be cleaned before each filling cycle. Theoretically, they could be filled top-side-up however, the dip tube cannot practically reach the lowermost part of the keg as this would block the tube and thus prevent flow, so it would not be possible to effectively remove 100% of any cleaning agents used. For this reason kegs are normally filled with the valve oriented downwards (top-side-down).

FIG. 3 shows a typical filling head as used in top-side-down filling systems. The filling head has an outer body E with a keg guide ring F to locate the keg, with a keg interface seal G inside the guide ring sealing against an outer collar of the valve. A sliding core H inside the outer body E opens the valve and conducts gas in and out of the keg through pathway B1. Liquids enter or leave the keg via pathway A1 between the core H and the seal G. As the entrance to the first flow path within the keg is adjacent to the valve, cleaning agents etc. can be effectively removed. As these kegs are in widespread use, there are a great many existing top-side-down filling machines in general use ranging from single head manual systems to complex multi-head automatic systems with high production capacities.

The filling process aims to maintain strict hygiene and normally takes several minutes. A typical filling process is as follows:

- Connect a filling head to the valve.
- Wash the valve outer surfaces (usually with stem or hot water).
- Open the valve.

- Introduce pressurised gas through the second flow path (usually $CO_2$ or $N_2$ as residual oxygen can degrade the beer). This drives out any beer remaining in the keg through the first flow path. (If the keg has previously been used to dispense beer there is invariably at least a small amount remaining that was below the level of the bottom of the dip tube.)
- Vent the second flow path and introduce cleaning agents via the first flow path.
- Introduce pressurised gas through the second flow path and drain the cleaning agents via the first flow path.
- Introduce beer via the first flow path and vent the displaced gas via the second flow path.

It is generally accepted that the beer should not be subjected to excessive turbulence as it enters the keg as this creates foam and can have a detrimental effect on the beer quality. As the beer enters at the bottom of the keg, there is a relatively short period of turbulence on initial entry, but as the beer pools in the bottom this dampens the effect and the remainder of the fill is relatively free from excessive turbulence. When the desired amount of beer has been introduced both paths are closed and the connecting coupler is detached.

A relatively recent innovation in beer kegs is the so-called bag-in-keg container. In this case a flexible bag is used within the keg to hold the beer and physically separate the gas and beer. This gives some qualitative advantages to the system. It is not practical to re-use the bags as they are extremely difficult to clean effectively after use. Therefore, bag-in-keg systems are invariably single use with the container, chimes and two-port valve being of recyclable plastics. In these systems, the bag is connected to the second flow path of the two-port valve with the first flow path serving the space between the bag and the outer container. In a preferred configuration, a dip-tube is included within the bag. This dip tube ensures that the liquid is dispensed for the bottom of the keg and therefore minimises a phenomenon known as 'fobbing' during dispense. Fobbing is the presence of significant amounts of gas/foam being dispensed with or instead of liquid. In conventional kegs, fobbing occurs normally when the keg empties of liquid, and the level falls below the bottom of the dip-tube. This can cause problems with the dispense system, and often so-called anti-fobbing devices are fitted to shut-off the beer flow if fobbing is detected.

It is not necessary to use a dip-tube in a bag-in-keg system, as the displacing gas pressure acting on the outside of the bag is enough to literally 'squeeze' the beer out through the second path. However, in bag-in-keg configurations without a dip-tube, fobbing can occur at any time during dispense if the dispensing gas pressure falls below carbonation pressure of the liquid. In this case, the low pressure allows gas to effervesce from the liquid and as the outlet port is at the top of the bag, the gas is dispensed along with or instead of the beer.

FIG. 4 shows a preferred bag-in-keg container configuration. This particular embodiment shows a single use polymer (PET) container C body with the bag J (of flexible polymer) closed around an internal dip tube D at the two-port valve V. Such preferred bag-in-keg containers must be filled through the dip-tube as this is the only route in and out of the bag J. With top-side-down filling equipment filling process can create excessive turbulence as the beer enters the bag through an upwardly facing tube causing a fountain effect. This turbulence can have a detrimental effect on both filling speed and beverage quality. As can be seen in FIG. 5, the beer pools at the bottom of the bag so it does not dampen this fountain effect, as indicated at K, which is therefore maintained throughout the filling process, reducing the filling speed and degrading the quality of the beer. Note: When filling a bag-in-keg system that does not include a dip-tube, the liquid enters at the bottom, similar to a conventional keg, and thus there is no fountain effect.

While the dip tube minimises the possibility of fobbing during dispensing, it can cause some undesirable effects when dispensing liquids that have suspended particulates e.g. craft beers. In these cases, a sediment can form on the bottom surface of the keg during the time between filling and dispensing. If the dip-tube is extended substantially toward this bottom surface, it can cause some of this sediment to be sucked-up during dispense. For this reason, it is generally preferred to position the bottom end of the dip tube further away from the bottom surface, but this often results in increased risk of fobbing when the liquid level reaches the end of the dip tube.

One objective of the present invention is to providing a simple but effective means of reducing frothing and turbulence when filling bag-in-keg containers with a dip tube using top-side-down filling equipment.

A second objective is to provide a means of reducing the risk of fobbing and the dispensing of particulates in any keg having a dip tube.

SUMMARY OF THE INVENTION

This invention provides a bag-in-keg container:

a container body (C);

a bag (J) within the container body;

a two-port valve (V) providing a first pathway (A) for gas and a second pathway (B) for liquid, said first pathway communicating with a space between the container (C) and the bag (J), and the second pathway communicating with the interior of the bag;

a container dip tube (D) within the bag connected to the second pathway (B) of the two port valve (V);

characterised in that an end section of the container dip tube (D) has a flow terminal (1), said flow terminal defining a flow passage (8, 9) arranged to communicate with said liquid flow path and which includes a counter-flow portion (8) leading to an opening (4), wherein the direction of liquid flow through said opening (4) is reversed relative to the direction of liquid flow through said end section of the container dip tube (D).

During filling of the bag-in-keg container the flow terminal re-directs the incoming flow to run smoothly back down the outside of the dip tube, gently into the already pooled liquid thus minimising any fountain effect and associated turbulence.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

The drawings show two forms of flow terminal for use with a container dip tube of a bag-in-keg container of the kind described in the introductory paragraphs above. The flow terminals can also be used with conventional single-wall kegs formed of metal or plastics, which are also described above.

Figure 1:
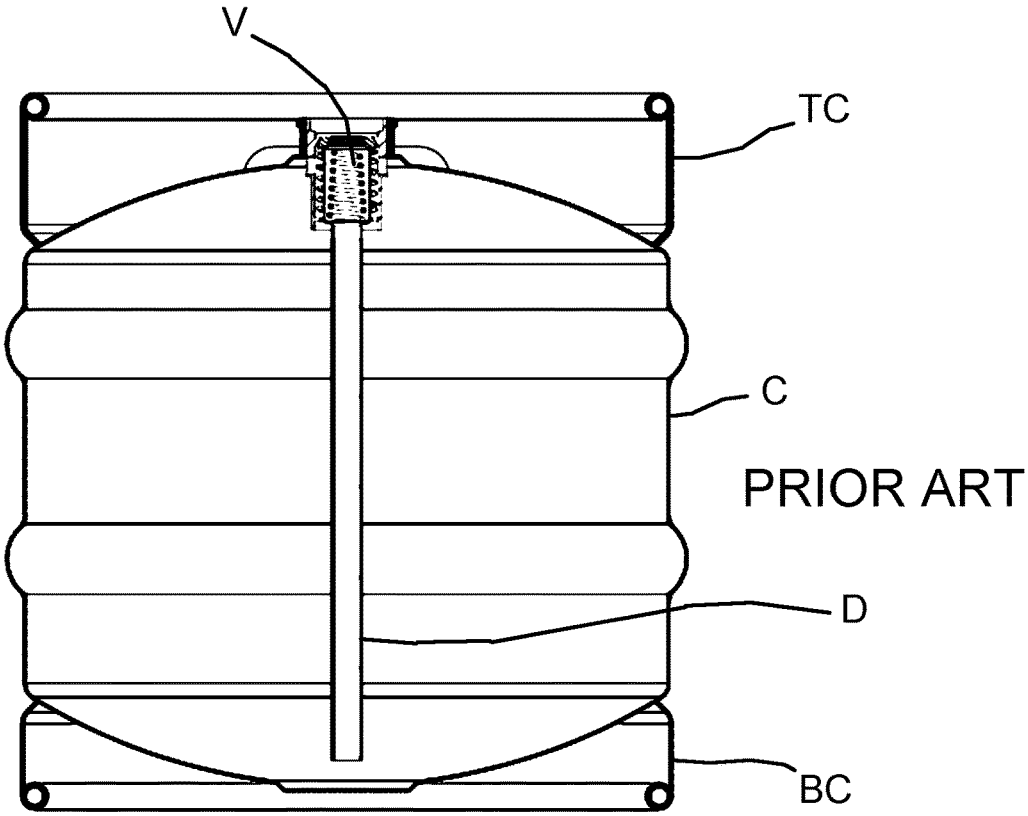
FIG. 1 is a sectional view of a conventional metal keg.
Figure 2:
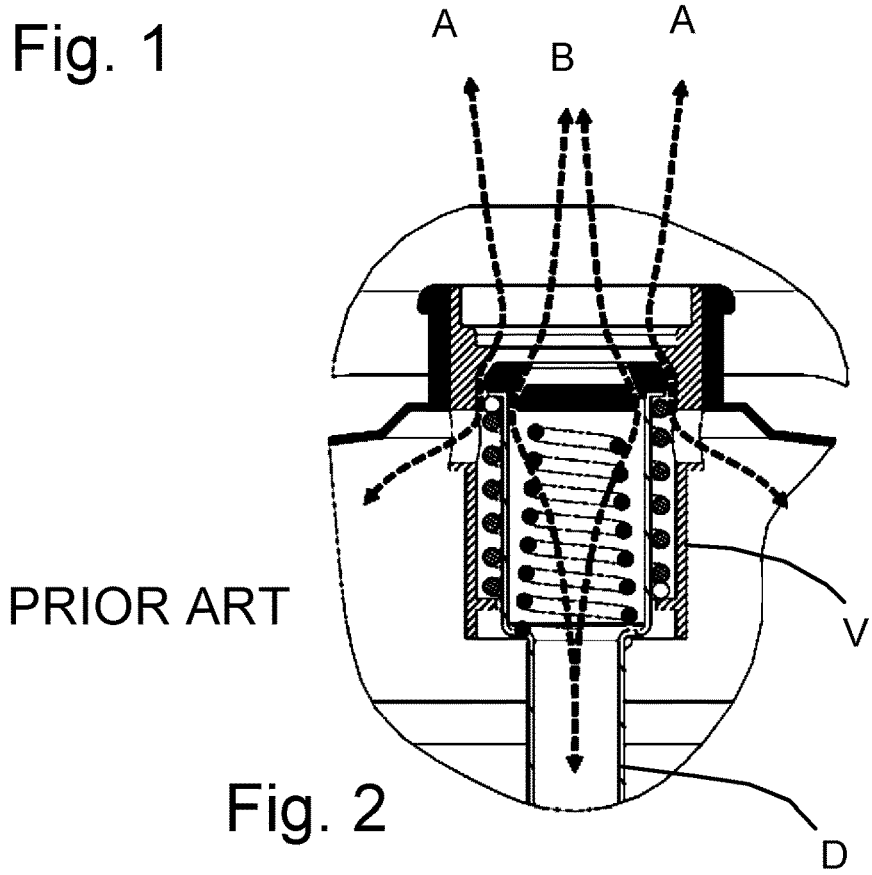
FIG. 2 is a detailed sectional view of a typical two-port valve as used in such a keg.
Figure 3:
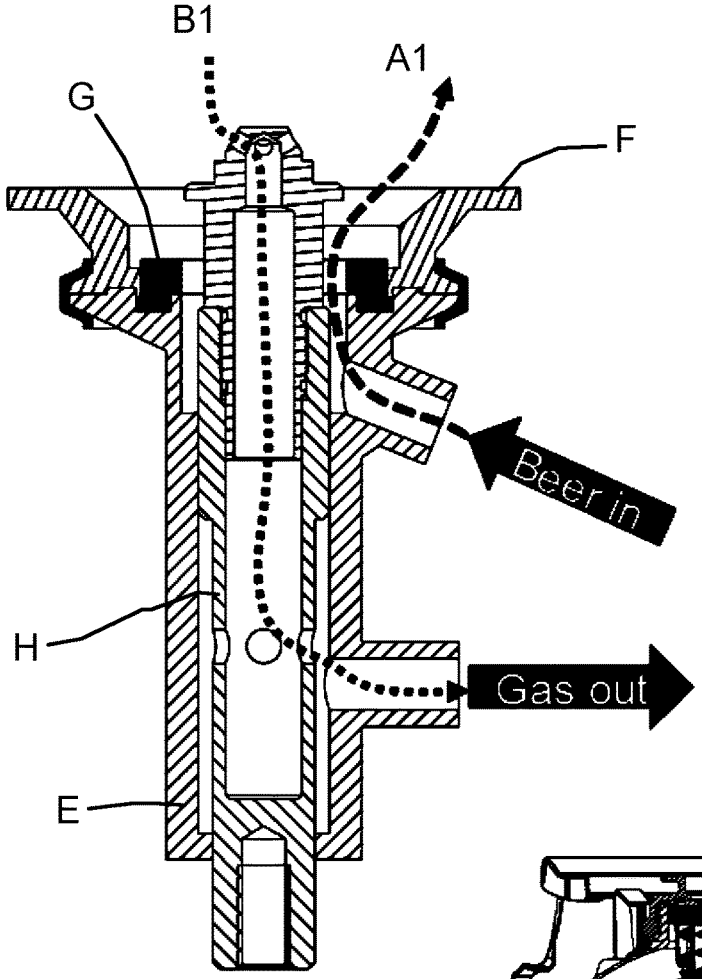
Fig. 3 PRIOR ART
FIG. 3 is a sectional view of a typical filling head as used in top-side down keg filling equipment.
Figure 4:
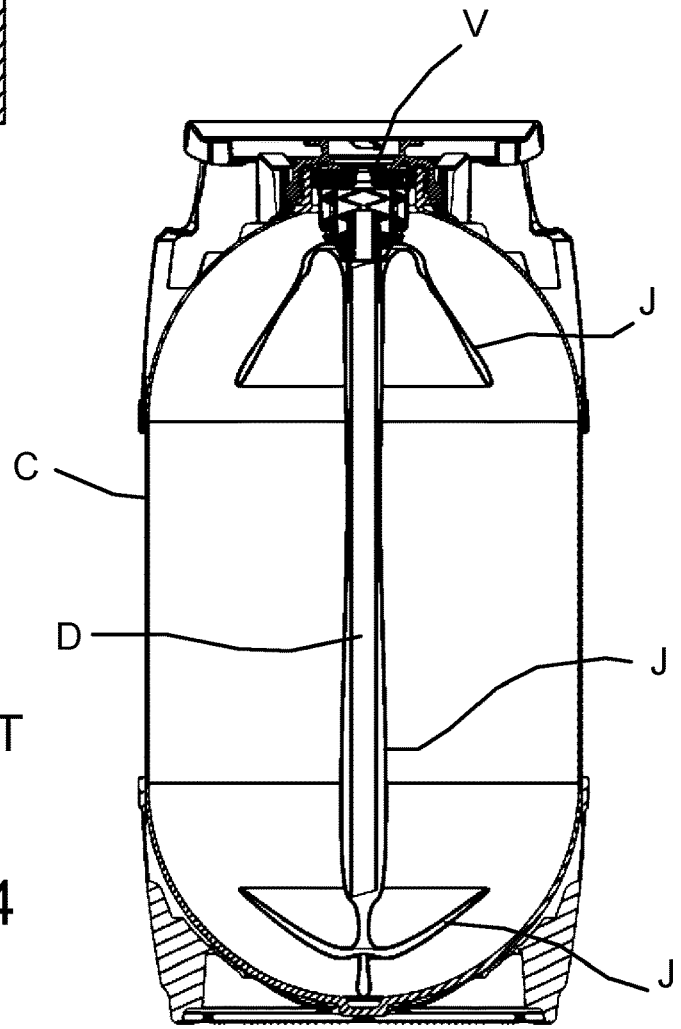
PRIOR ART Fig. 4
FIG. 4 is a sectional view of a preferred bag-in-keg container.
Figure 5:
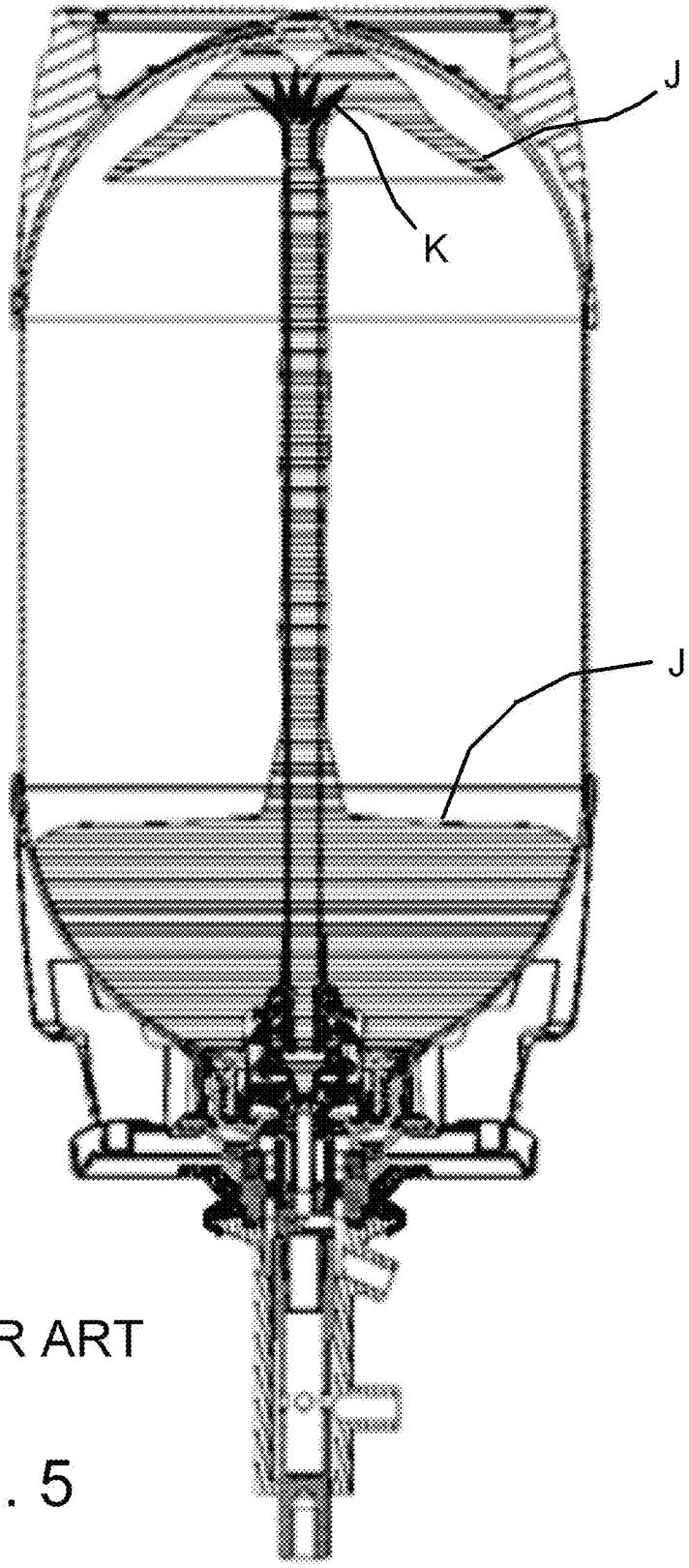
PRIOR ART Fig. 5
FIG. 5 is a sectional view of a partially filled bag-in-keg container being filled using top-side-down filling equipment.
Figure 6:
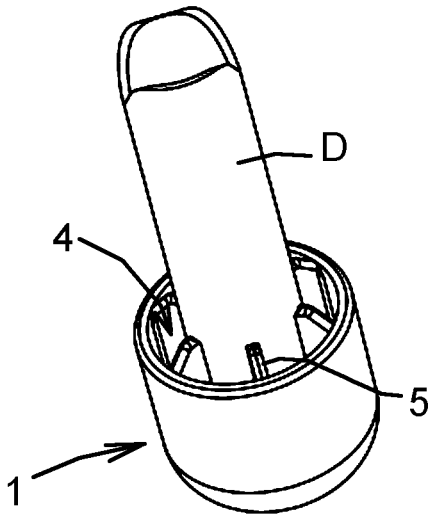
FIG. 6 is a general view of a first form of flow terminal fitted to a container dip tube.
Figure 7:
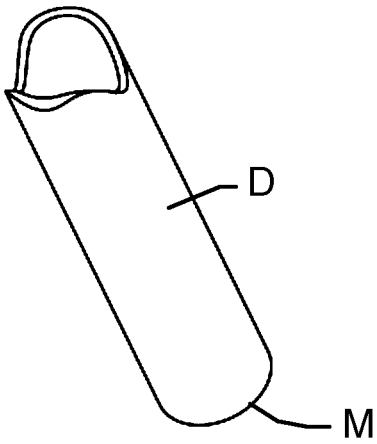
FIG. 7 is a similar view of the flow terminal detached from the dip tube.
Figure 9:
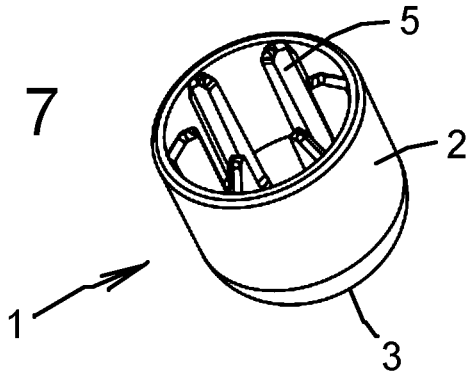
FIG. 9 is an axial section through the flow terminal and dip tube.
Figure 8:
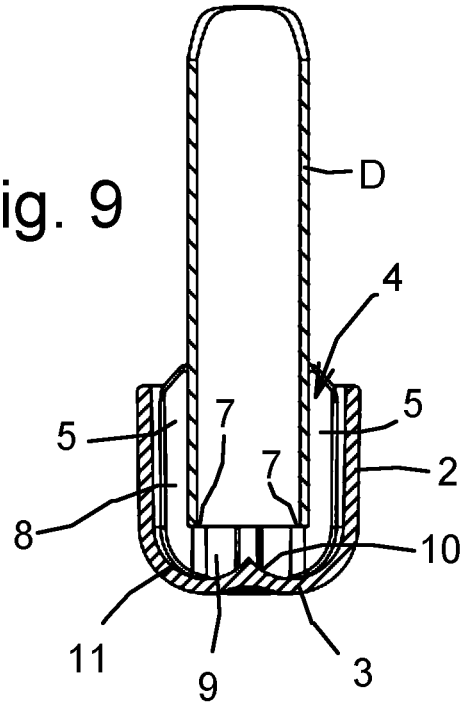
FIG. 8 is a top plan view of the flow terminal.
Figure 8:
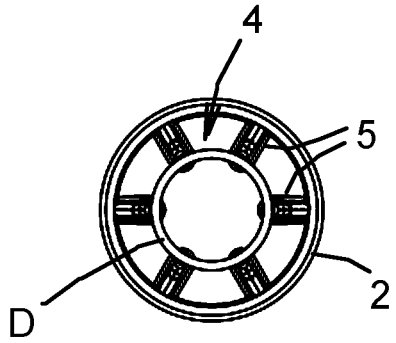

Referring to FIGS. 6 and 7, the flow terminal 1 is a one-piece plastic injection moulding for engagement with an end section of the container dip tube D which contains a liquid flow path extending axially thereof and exiting through an open end M of the dip tube. The flow terminal is generally cup-shaped with a cylindrical outer wall 2 and an end wall 3 closing one end of the outer wall. The opposite end of the outer wall 2 provides an annular opening 4. Retaining means are provided to enable the flow terminal to be connected to the end section of the dip tube D. In this embodiment the retaining means comprise fins 5 (six in the embodiment shown) which project radially inwards from the outer wall 2, as shown in FIG. 8. The fins 5 extend axially within the outer wall 2 from the opening 4 to the end wall 3, as shown in FIG. 9. The inner faces 6 of the fins 5 are substantially straight, with a small inward step 7 being provided in each fin to act as spacer means. The dip tube D is a push-fit between the fins 5 and is inserted into the flow terminal until the open end M contacts the inward steps 7. The fins 5 thus form an annular space 8 between the outer wall 2 and the end section of the dip tube D, with a gap 9 between the end of the dip tube and the end wall 3. The flow terminal may be held on the dip tube D by frictional engagement between the fins 4 and the dip tube, with or without additional attachment means such as adhesive, solvent welding etc.

A continuous flow passage is thus provided from the interior of the dip tube D through open end M, into the gap 9, which in turn leads into the space 8 between the dip tube D and the outer wall 2, exiting through the opening 4. The space 8 provides a counter-flow portion leading to the opening 4, so that the direction of liquid flow through the opening 4 is reversed relative to the axial direction of liquid flow through the dip tube D.

Figure 15:
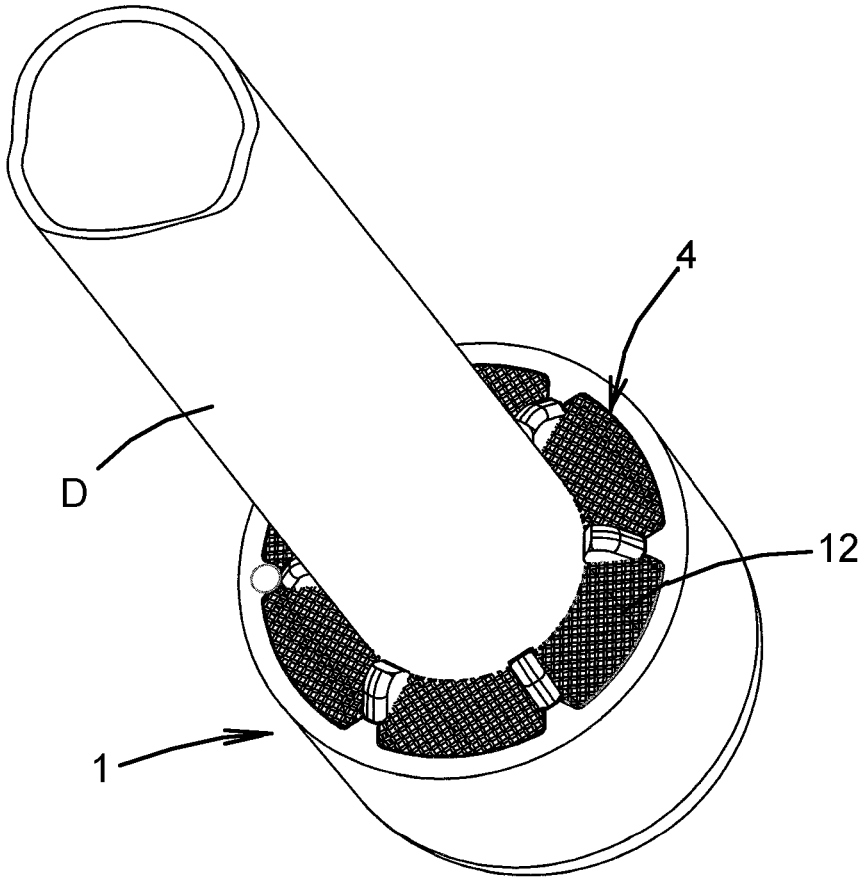
FIG. 15 is a general view of a modified flow terminal which is fitted to a container dip tube.

Several features are incorporated in this flow terminal which help to minimise turbulence and ensure smooth linear flow exiting from the opening 4. Firstly, the end wall 3 is provided with a generally conical projection 10 located co-axially with the open end M of the dip tube D, which distributes the flow evenly in all radial directions. Secondly, the junction between the end wall 3 and the outer wall 2 is internally smoothly curved at 11 to continue the smooth flow of liquid into the counter-flow space 8. Thirdly, the fins 5 divide the axial flow through the space 8 into six parallel sub-passages which helps to ensure that the flow exiting from the opening 4 is parallel to the axis of the dip tube D and non-turbulent. A further feature which can usefully be included, one embodiment of which is shown in FIG. 15, is to include a fine mesh 12 within the opening 4. This mesh 12 further reduces turbulence and regularises the flow down the outside of the dip tube D, thereby further lowering the impact of the flow when it enters the pool. The mesh pattern can of course vary within the scope of the invention, and the mesh could be fixed in various ways.

Figure 10:
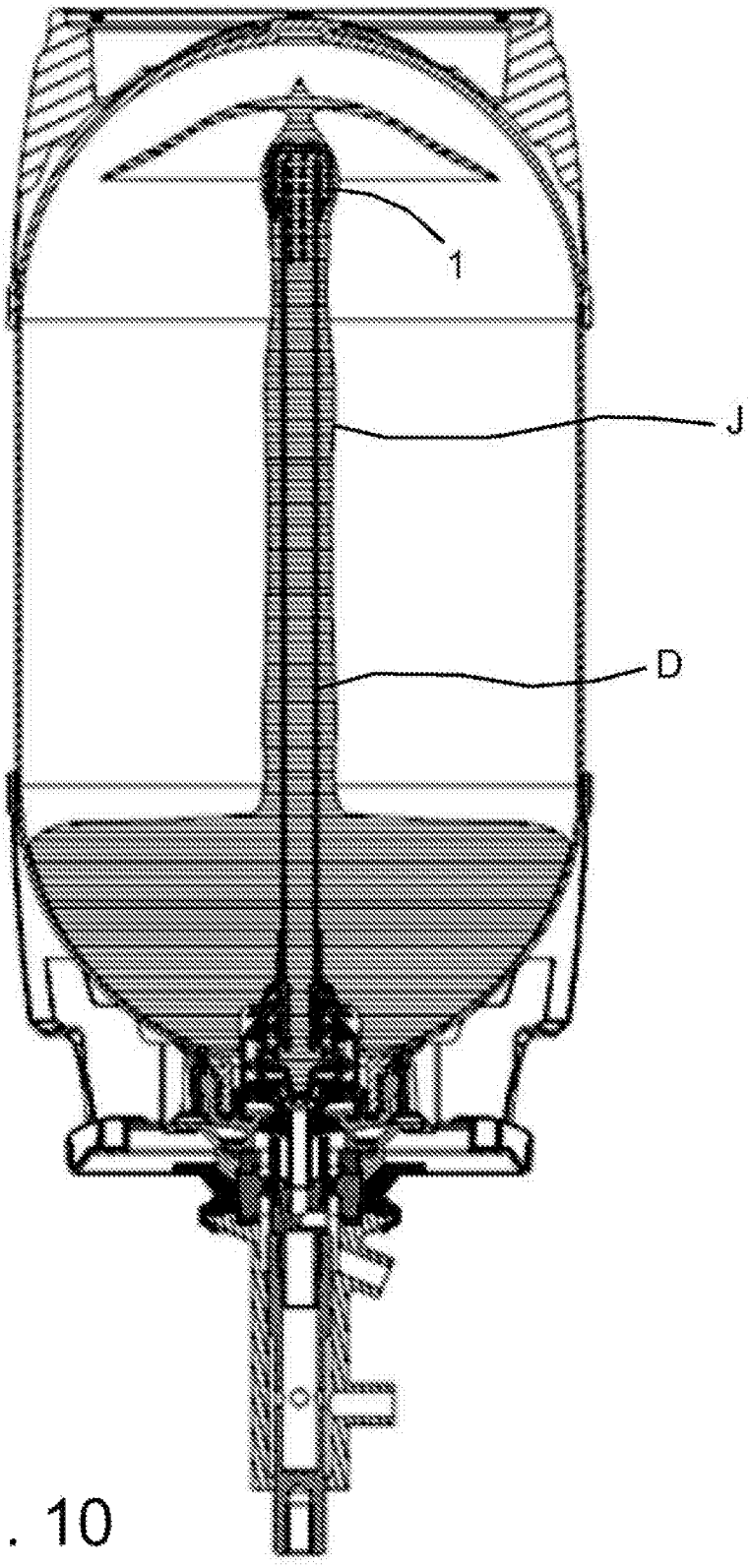
FIG. 10 is a sectional view of a partially filled bag-in-keg container provided with the flow terminal during top-side-down filling.

When used in a bag-in-keg container with a two-port valve, such as a beer keg, during top-side-down filling as shown in FIG. 10, the flow terminal 1 directs the incoming flow to run smoothly back down the outside of the dip tube D, passing gently into the already pooled beer at the lower end of the bag J, thus reducing or eliminating any fountain effect and associated turbulence.

Figure 11:
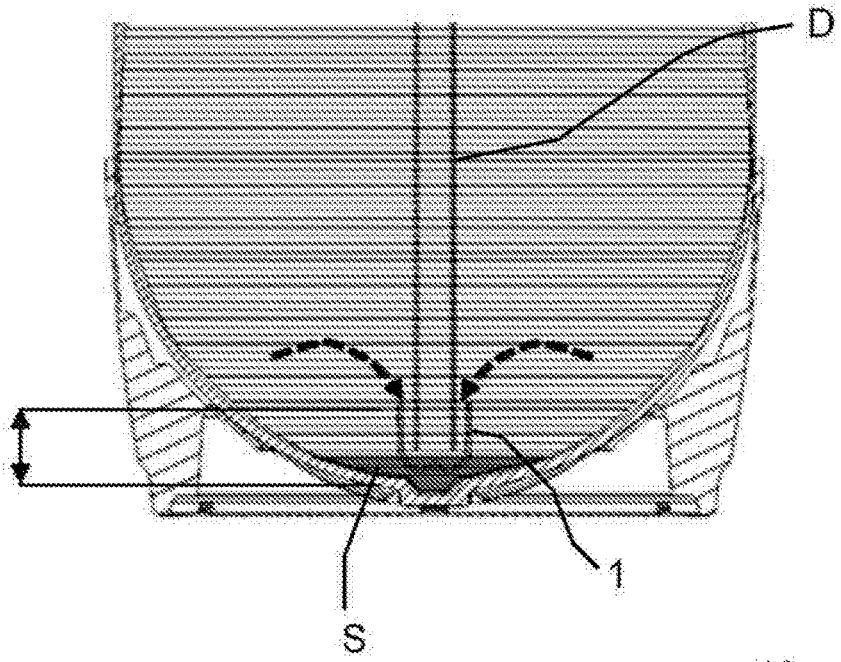
FIG. 11 is a sectional view of a conventional plastic keg provided with the flow terminal, during dispensing.

The flow terminal can also be used with conventional single-wall kegs of metal or plastics fitted with a two-port valve when dispensing craft beers or other liquids that have suspended particulates. As shown in FIG. 11, the flow terminal reverses the flow into the dip tube D so that the outgoing liquid is not sucked from the bottom of the keg, but from the opposite direction. A dip tube fitted with this flow terminal 1 can extend further down into the container, reducing the risk of sediment S being dispensed and enabling a greater volume of liquid to be withdrawn before fobbing begins.

Figure 13:
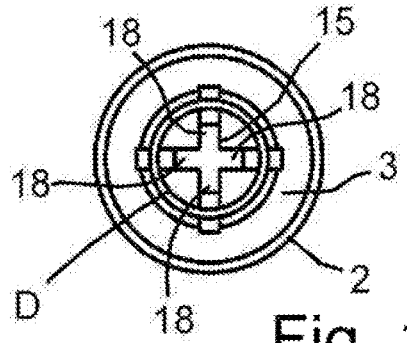
FIG. 13 is a top plan view of the second flow terminal.
Figure 12:
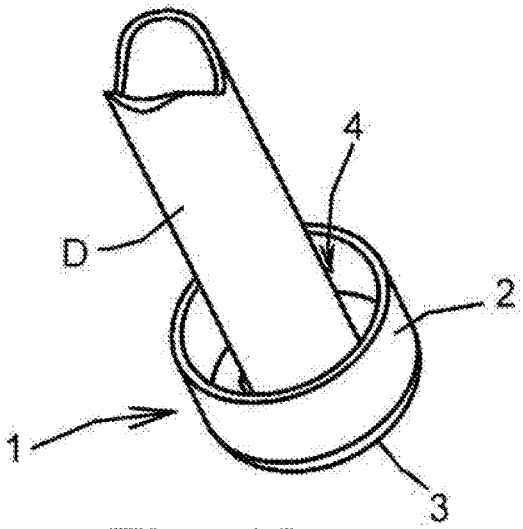
FIG. 12 is a general view of a second form of the flow terminal fitted to a container dip tube.
Figure 14:
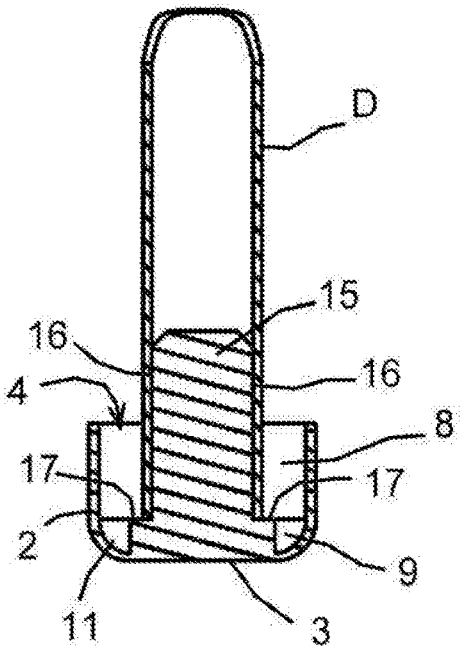
FIG. 14 is an axial section through the second flow terminal and dip tube.

Referring to FIG. 12, the second flow terminal 1 is another one-piece plastic injection moulding for engagement with an end section of the container dip tube D which contains a liquid flow path exiting through an open end of the dip tube. The flow terminal is generally cup-shaped with a cylindrical outer wall 2 and an end wall 3 closing one end of the outer wall. The opposite end of the outer wall 2 provides an annular opening 4. Retaining means are provided to enable the flow terminal to be connected to the end section of the dip tube D. In this embodiment the retaining means comprise a pin 15 of cruciform cross-section which projects upwardly from the end wall 3, as shown in FIG. 13. The outer faces 16 of the pin 15 are substantially straight, with a small outward step 17 forming spacer means. The dip tube D is a push-fit onto the pin 15 and is inserted into the flow terminal until the open end M contacts the steps 17. An annular space 8 is formed between the outer wall 2 and the end section of the dip tube D, with a gap 9 between the end of the dip tube and the end wall 3. The flow terminal may be held onto the dip tube D by frictional engagement between the pin 15 and the dip tube, with or without additional attachment means such as adhesive, solvent welding etc.

Although a pin 15 with a cruciform cross-section is easy to mould it will be appreciated that any regular cross-sectional shape could be used which has a plurality of radially-projecting fins 18 extending outwards from a central axis, e.g. three, five or six fins. The important thing to note is that the pin 15 acts to divide the flow of liquid within the dip tube into a number of equal and parallel streams.

A continuous flow passage is provided from the interior of the dip tube D through open end M, into the gap 9, which in turn leads into the space 8 between the dip tube D and the outer wall 2, exiting through the opening 4. The space 8 provides a counter-flow portion leading to the opening 4, so that the direction of liquid flow through the opening 4 is reversed relative to the axial direction of liquid flow through the dip tube D.

Features incorporated in this flow terminal help to minimise turbulence and ensure smooth linear flow exiting from the opening 4. The pin 15 divides the flow into a number of equal streams and distributes the flow evenly in all radial directions. The junction between the end wall 3 and the outer wall 2 is also internally smoothly curved at 11 to continue the smooth flow of liquid into the counter-flow space 8 which helps to ensure that the flow exiting from the opening 4 is parallel to the axis of the dip tube D and non-turbulent. A mesh 12 could advantageously be included in the opening 4 as described above in relation to FIG. 15.

This second form of flow terminal can be used with bag-in-keg containers as well as single-wall containers as described above.

It should be noted that in the flow terminals described herein the outer wall 2 need not be cylindrical, e.g. hexagonal. Furthermore, the flow terminal could be integrally formed with the dip tube.

Whilst the above description places emphasis on the areas which are believed to be new and addresses specific problems which have been identified, it is intended that the features disclosed herein may be used in any combination which is capable of providing a new and useful advance in the art.

The invention claimed is:

1. A bag-in-keg container:

a container body (C);

a bag (J) within the container body;

a two-port valve (V) providing a first pathway (A) for gas and a second pathway (B) for liquid, said first pathway communicating with a space between the container (C) and the bag (J), and the second pathway communicating with the interior of the bag;

a container dip tube (D) within the bag connected to the second pathway (B) of the two port valve (V); wherein an end section of the container dip tube (D) has a flow terminal (1), said flow terminal defining a flow passage (8, 9) arranged to communicate with said liquid flow path and which includes a counter-flow portion (8) leading to an opening (4), whereby the direction of liquid flow through said opening (4) is reversed relative to the direction of liquid flow through said end section of the container dip tube (D);

wherein said flow terminal (1) includes an outer wall (2) to surround the end section of said dip tube, and wherein said counter-flow portion (8) is defined by a space between said outer wall and said end section;

wherein said flow terminal (1) includes an end wall (3) closing one end of said outer wall; and wherein said flow terminal (1) includes retaining means (15) to connect the flow terminal to said end section of the dip tube and wherein said retaining means includes a pin (15) secured to said end wall (3).

2. A bag-in-keg container according to claim 1 wherein the pin (15) has a plurality of fins (18) extending radially outwards from a central axis.

3. A bag-in-keg container:

a container body (C);

a bag (J) within the container body;

a two-port valve (V) providing a first pathway (A) for gas and a second pathway (B) for liquid, said first pathway communicating with a space between the container (C)

and the bag (J), and the second pathway communicating with the interior of the bag;

a container dip tube (D) within the bag connected to the second pathway (B) of the two port valve (V);

wherein an end section of the container dip tube (D) has a flow terminal (1), said flow terminal defining a flow passage (8, 9) arranged to communicate with said liquid flow path and which includes a counter-flow portion (8) leading to an opening (4), whereby the direction of liquid flow through said opening (4) is reversed relative to the direction of liquid flow through said end section of the container dip tube (D);

wherein said flow terminal (1) includes an outer wall (2) to surround the end section of said dip tube, and wherein said counter-flow portion (8) is defined by a space between said outer wall and said end section;

wherein said flow terminal (1) includes an end wall (3) closing one end of said outer wall;

wherein said flow terminal (1) includes spacer means (7; 17) forming a gap between said end section of the dip tube and said end wall (3); and wherein said flow terminal (1) includes a plurality of fins (5) which extend radially inwards from said outer wall (2) and wherein the spacer means is formed by a step (7) on the fins (5).

4. A bag-in-keg container according to claim 3 in which the end wall (3) contains a projection (10) co-axial with the dip tube.

5. A bag-in-keg container according to claim 3 in which the junction between the end wall (3) and the outer wall (2) is internally curved (11).

6. A bag-in-keg container according claim 1 in which the opening (4) includes a mesh (12).

7. A bag-in-keg container:

a container body (C);

a bag (J) within the container body;

a two-port valve (V) providing a first pathway (A) for gas and a second pathway (B) for liquid, said first pathway communicating with a space between the container (C) and the bag (J), and the second pathway communicating with the interior of the bag;

a container dip tube (D) within the bag connected to the second pathway (B) of the two port valve (V);

wherein an end section of the container dip tube (D) has a flow terminal (1), said flow terminal defining a flow passage (8, 9) arranged to communicate with said liquid flow path and which includes a counter-flow portion (8) leading to an opening (4), whereby the direction of liquid flow through said opening (4) is reversed relative to the direction of liquid flow through said end section of the container dip tube (D);

wherein said flow terminal (1) includes an outer wall (2) to surround the end section of said dip tube, and wherein said counter-flow portion (8) is defined by a space between said outer wall and said end section;

wherein said flow terminal (1) includes an end wall (3) closing one end of said outer wall;

wherein said flow terminal (1) includes spacer means (7; 17) forming a gap between said end section of the dip tube and said end wall (3); and wherein said flow terminal (1) includes a pin (15) secured to said end wall (3) and wherein the spacer means (17) is formed by a step on the pin (15).

8. A bag-in-keg container according to claim 7 in which the junction between the end wall (3) and the outer wall (2) is internally curved (11).

9. A bag-in-keg container according claim 7 in which the opening (4) includes a mesh (12).

* * * * *